US011041252B2

(12) United States Patent
Piascik et al.

(10) Patent No.: US 11,041,252 B2
(45) Date of Patent: Jun. 22, 2021

(54) DEPOSITION OF WEAR RESISTANT NICKEL-TUNGSTEN PLATING SYSTEMS

(71) Applicant: HONEYWELL INTERNATIONAL INC., Morris Plains, NJ (US)

(72) Inventors: James Piascik, Randolph, NJ (US); Gangmin Cao, Shanghai (CN); Amer Aizaz, Phoenix, AZ (US); Jingkang Lv, Shanghai (CN); Bahram Jadidian, Watchung, NJ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 324 days.

(21) Appl. No.: 15/928,569

(22) Filed: Mar. 22, 2018

(65) Prior Publication Data

US 2019/0292678 A1 Sep. 26, 2019

(51) Int. Cl.
*C25D 3/12* (2006.01)
*C25D 15/00* (2006.01)
(Continued)

(52) U.S. Cl.
CPC ..... *C25D 15/00* (2013.01); *C10M 103/04* (2013.01); *C10M 103/06* (2013.01); *C25D 3/56* (2013.01);
(Continued)

(58) Field of Classification Search
CPC ... C25D 3/12; C25D 5/10; C25D 9/02; C25D 3/02; C25D 5/54
See application file for complete search history.

(56) References Cited

U.S. PATENT DOCUMENTS 3,775,628 A 11/1973 Andersson et al.
3,932,928 A 1/1976 King
(Continued)

FOREIGN PATENT DOCUMENTS

CN 104862764 A 8/2015
CN 106011955 A 10/2016
(Continued)

OTHER PUBLICATIONS

Fahami, et al.; Influence of Surfactants on the Characteristics of Nickel Matrix Nanocomposite Coatings; Hindawi Publishing Corporation ISRN Electrochemistry; vol. 2013, Article ID 486050.
(Continued)

*Primary Examiner* — Zulmariam Mendez
(74) *Attorney, Agent, or Firm* — Lorenz & Kopf, LLP

(57) ABSTRACT

Methods for depositing wear resistant NiW plating systems on metallic components are provided. In various embodiments, the method includes the step or process of preparing a NiW plating bath containing a particle suspension. The NiW plating bath is prepared by introducing wear resistant particles into the NiW plating path and adding at least one charged surfactant. The first type of wear resistant particles and the first charged surfactant may be contacted when introduced into the NiW plating bath or prior to introduction into the NiW plating bath. The at least one charged surfactant binds with the wear resistant particles to form a particle-surfactant complex. The wear resistant NiW plating system is then electrodeposited onto a surface of a component at least partially submerged in the NiW plating bath. The resulting wear resistant NiW plating system comprised of a NiW matrix in which the wear resistant particles are embedded.

9 Claims, 2 Drawing Sheets

(51) Int. Cl.

| | |
|---|---|
| ***C10M 103/04*** | (2006.01) |
| ***C10M 103/06*** | (2006.01) |
| ***C25D 3/56*** | (2006.01) |
| *C10N 30/06* | (2006.01) |
| *C10N 50/08* | (2006.01) |

(52) U.S. Cl.

CPC ..... *C25D 3/562* (2013.01); *C10M 2201/053* (2013.01); *C10M 2201/0623* (2013.01); *C10N 2030/06* (2013.01); *C10N 2050/08* (2013.01)

(56) References Cited

U.S. PATENT DOCUMENTS

| | | | |
|---|---|---|---|
| 4,376,904 | A | 3/1983 | Horrigan |
| 4,950,438 | A | 8/1990 | Nakamura et al. |
| 5,460,503 | A | 10/1995 | Kitajima et al. |
| 7,147,929 | B2 | 12/2006 | Amagi et al. |
| 7,513,029 | B2 | 4/2009 | Ortt et al. |
| 7,893,583 | B2 | 2/2011 | Du et al. |
| 2004/0010908 | A1 | 1/2004 | Kobayashi |
| 2005/0127774 | A1 | 6/2005 | Sogabe et al. |
| 2008/0007134 | A1 | 1/2008 | Shimura et al. |
| 2009/0273254 | A1 | 11/2009 | Heim |
| 2012/0126642 | A1 | 5/2012 | Miyamoto et al. |
| 2012/0169174 | A1 | 7/2012 | Radov et al. |
| 2012/0175991 | A1 | 7/2012 | Tassinario et al. |
| 2014/0030635 | A1 | 1/2014 | Nakada et al. |

FOREIGN PATENT DOCUMENTS

| | | | |
|---|---|---|---|
| CN | 106283139 | A | 1/2017 |
| DE | 102007034322 | A1 | 1/2009 |
| GB | 569196 | A | 5/1945 |
| JP | 2012105392 | | 5/2012 |
| WO | 2013122760 | A1 | 8/2013 |
| WO | 2016033301 | A1 | 3/2016 |

OTHER PUBLICATIONS

Aal et al., Electrodeposited Composite Coating of Ni—W—P with Nano-sized Rod- and Spherical-shaped SiC Particles, Materials Research Bulletin, Jan. 8, 2009, pp. 151-159, 44-1, Kidlington, GB.

DEPOSITION OF WEAR RESISTANT NICKEL-TUNGSTEN PLATING SYSTEMS

TECHNICAL FIELD

The following disclosure relates generally to plating processes and, more particularly, to methods for depositing nickel-tungsten plating systems containing wear resistant particles, which enhance certain properties of the plating system.

ABBREVIATIONS

Abbreviations appearing relatively infrequently in this document are defined upon initial usage, while abbreviations appearing more frequently in this document are defined below.

CTAB—cetyltrimethylammonium bromide;
h-BN—hexagonal boron nitride;
MPa—Megapascal;
NiW—Nickel-Tungsten;
PEG-8—methyl ether dimethicone;
SDS—sodium dodecyl sulfate;
SEM—scanning electron microscope;
wt %—weight percent; and
° C.—degrees Celsius.

BACKGROUND

Hexavalent chromium or, more simply, "hex chrome" is traditionally plated onto metallic components for improved corrosion and high temperature wear resistance purposes. However, the benefits provided by hex chrome plating deposits, particularly as they relate to enhancements in high temperature wear resistance, remain limited. This limitation, combined with increasing environmental concerns pertaining to hex chrome usage, has compelled the development of other plating systems capable of providing improved wear resistance properties at high temperatures; e.g., resistance to abrasion and other surface damage when subject to contact forces at elevated temperatures exceeding about 400° C. NiW plating systems, for example, have been identified as promising candidates for imparting increased high temperature wear resistance to metallic component surfaces when subject to light to moderate contact forces; e.g., contact forces less than about 400 pounds-per-square inch (psi) or about 2.76 MPa. At contact forces exceeding this threshold, however, conventional NiW plating systems remain undesirably prone to galling and other surface wear damage under elevated temperature operating conditions.

An industry demand thus persists for improved NiW plating systems, which are capable of providing enhanced wear or abrasion resistance when subject to higher contact forces (e.g., contact forces exceeding about 2.76 MPa) under high temperature operating conditions (e.g., at temperatures exceeding about 400° C.). Ideally, embodiments of such improved NiW plating systems would also possess other beneficial properties, such as relatively high lubricities and microhardness levels. As a corollary, there likewise exists an ongoing demand for methods by which wear resistant NiW plating systems can be formed over selected surfaces of metallic components in a relatively efficient, cost-effective, and repeatable manner. Other desirable features and characteristics of embodiments of the present invention will become apparent from the subsequent Detailed Description and the appended Claims, taken in conjunction with the accompanying drawings and the foregoing Background.

BRIEF SUMMARY

Methods for depositing wear resistant NiW plating systems on metallic components are provided. In various embodiments, the method includes the step or process of preparing a NiW plating bath containing a particle suspension. The NiW plating bath is prepared by introducing wear resistant particles into the NiW plating path and adding to the NiW plating bath at least one charged surfactant. The first type of wear resistant particles and the first charged surfactant may be contacted when introduced into the NiW plating bath or prior to introduction into the NiW plating bath. When so contacted, the at least one charged surfactant binds with the wear resistant particles to form a particle-surfactant complex. The wear resistant NiW plating system is then electrodeposited onto a surface of a component at least partially submerged in the NiW plating bath. The resulting wear resistant NiW plating system comprised of a NiW matrix in which the wear resistant particles are embedded.

In further embodiments, the method includes the step or process of contacting wear resistant particles with an anionic surfactant to produce an intermediary particle-surfactant complex having a net negative charge. After contacting the wear resistant particles with the anionic surfactant, the intermediary particle-surfactant complex is contacted with the cationic surfactant to yield a particle-surfactant complex having a net positive charge. The particle-surfactant complex is then dispersed in a NiW plating bath, which is utilized to deposit the wear resistant NiW plating system over a surface of a component. In certain cases, the wear resistant particles may be pre-coated with the anionic surfactant and the cationic surfactant prior to dispersal of the particle-surfactant complex in the NiW plating bath. In other embodiments, the method further includes the steps of selecting the anionic surfactant to comprise sodium dodecyl sulfate; and further selecting the cationic surfactant to comprise cetyltrimethylammonium bromide, methyl ether dimethicone, or a combination thereof.

In a still further embodiment, the method includes the steps or processes of: (i) contacting wear resistant particles with an anionic surfactant to produce an intermediary particle-surfactant complex having a net negative charge; and (ii) after contacting the wear resistant particles with the anionic surfactant, subsequently contacting the intermediary particle-surfactant complex with the cationic surfactant to yield a particle-surfactant complex having a net positive charge. The anionic surfactant assumes the form of or contains sodium dodecyl sulfate; while the cationic surfactant assumes the form of or contains cetyltrimethylammonium bromide, methyl ether dimethicone, or a combination thereof.

Various additional examples, aspects, and other useful features of embodiments of the present disclosure will also become apparent to one of ordinary skill in the relevant industry given the additional description provided below.

BRIEF DESCRIPTION OF THE DRAWINGS

At least one example of the present invention will hereinafter be described in conjunction with the following figures, wherein like numerals denote like elements, and.

Figure 1:
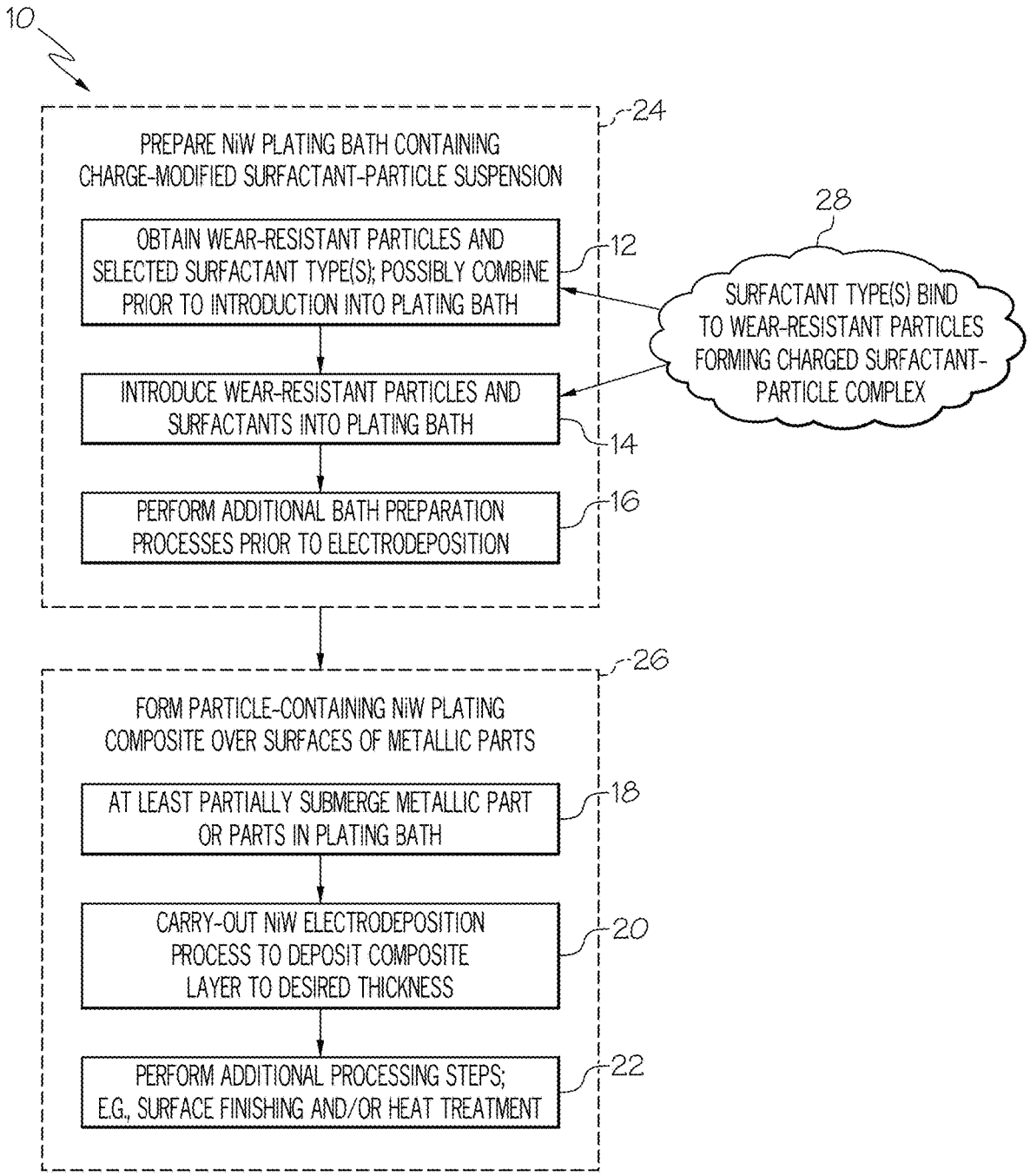
FIG. 1 is a flowchart of a method for forming a NiW plating composite or system, which contains wear resistant particles, over selected surfaces of metallic components, as illustrated in accordance with an exemplary embodiment of the present disclosure.

For simplicity and clarity of illustration, descriptions and details of well-known features and techniques may be omitted to avoid unnecessarily obscuring the exemplary and non-limiting embodiments of the invention described in the subsequent Detailed Description. It should further be understood that features or elements appearing in the accompanying figures are not necessarily drawn to scale unless otherwise stated.

DETAILED DESCRIPTION

The following Detailed Description is merely exemplary in nature and is not intended to limit the invention or the application and uses of the invention. The term "exemplary," as appearing throughout this document, is synonymous with the term "example" and is utilized repeatedly below to emphasize that the description appearing in the following section merely provides multiple non-limiting examples of the invention and should not be construed to restrict the scope of the invention, as set-out in the Claims, in any respect. As further appearing herein, statements indicating that a first layer is "bonded to" or "joined to" a second layer, surface, or body do not require that that the first layer is directly bonded to and intimately contact the second layer, surface, or body unless otherwise specifically stated. Finally, as still further appearing herein, the term "component" refers to any article of manufacture over which a coating or coating system can be formed. The term "component" is thus synonymous with or encompasses similar terms including "substrate," "part," and "workpiece."

As discussed briefly above, NiW plating systems are capable of providing enhanced wear resistance properties at elevated operating temperatures in the presence of light to moderate contact forces. However, when subject to both elevated operating temperatures and more severe contact forces (e.g., contact forces approaching or exceeding about 2.76 MPa), conventional NiW plating systems remain undesirably prone to abrasive surface damage, such as galling. It has been discovered that the high temperature wear resistance properties of NiW plating systems can be improved through the incorporation of wear resistant particles into the deposited NiW matrix. Ideally, such wear resistant particles are incorporated into the NiW plating system by co-deposition during electroplating.

Testing has demonstrated that NiW plating systems containing wear resistant particles embedded within NiW matrices are capable of achieving significantly improved wear resistances under elevated temperature conditions. For example, certain tests have been conducted by or performed on behalf of the present Assignee (Honeywell International, Inc.) demonstrating that NiW plating systems containing wear resistant particles demonstrate high temperature wear coefficients and microhardness values comparable to, if not better than the high temperature wear coefficients and microhardness values of conventional hex chrome platings. Further, the friction coefficients of such NiW plating systems may be substantially equivalent to, if not less than those provided by hex chrome plating deposits and other legacy plating materials. Such NiW plating systems are consequently well-suited for application onto high temperature contact (e.g., sliding) surfaces and may be ideal candidates for replacement of conventional hex chrome platings in a number of valve and engine applications, such as in protecting the sliding surfaces of valve body bores, actuator bores, and piston rods, to list but a few examples.

To produce a NiW plating composite or system containing wear resistant particles, the wear resistant particles are ideally co-deposited concurrently with the NiW matrix during the electroplating process in consistent, predictable manner. Further technical challenges are encountered, however, when attempting to co-deposit wear resistant particles from the bath chemistries utilized in NiW electroplating. As a principal challenge, it is often difficult to maintain the wear resistant particles in a substantially uniform suspension within the NiW plating bath over prolonged periods of time. Consequently, the resulting particle-containing NiW plating system may have a sub-optimal composition or distribution of the co-deposited particles, as taken through the composite's thickness, detracting from the wear performance of the plating system or composite. Further, the poor longevity of wear resistant particle suspensions within the plating bath and the tendency of such particles to rapidly settle can add undesired complexity, expense, and delay to the electroplating process generally. Limited improvements in wear resistant particle suspension stability and distribution can be achieved by fine tuning certain process parameters, such as pH levels, agitation intensities, wear resistant particle size and shape, and the quantity of particles in the plating bath. It has been discovered, however, that surprisingly pronounced improvements in the longevity and uniformity of wear resistant particle suspensions can be realized through the introduction of certain charged surfactant types into the plating bath chemistry.

As just stated, the introduction of charged surfactants into the plating bath chemistry may enhance particle suspension stability within a given NiW plating bath; that is, better ensure that the wear resistant particles are well-dispersed through the bath volume, while helping stave-off the gradual settling and possible agglomeration of the suspended particles over time. When properly selected and formulated with respect to wear resistant particle type and plating bath chemistry, such charged surfactants bind with the wear resistant particles to impart a desired cumulative electrical charge to the resulting particle-surfactant complex, which differs from the initial or native charge of the particles in an isolated or unbound state. This cumulative electrical charge enhances the longevity of particle suspension and distribution in the plating bath, particularly when combined with controlled pH levels and other complementary process parameters. Additionally, when possessing a net positive charge exceeding that of the wear resistant particles, considered in isolation, the net positive charge of the particle-surfactant complex may further aid in particle deposition via electrical attraction to the plated component, which may serve as a cathode during the electroplating process. Further, in certain cases, the charged modified particle-surfactant suspension may be created utilizing multiple surfactants, which carry opposing charges and which bind to the wear resistant particles to form a double layer particle-surfactant complex. Additional discussion in this regard is provided below. First, however, an overarching description of an exemplary process suitable for electrodepositing a particle-containing NiW plating system is set-forth in conjunction with FIG. 1.

Example of NiW Plating Bath Electroplating Process

FIG. 1 is a flowchart of an exemplary electroplating method 10, which can be carried-out to form a NiW coating system or composite over selected surfaces of metallic components, as illustrated in accordance with an exemplary embodiment of the present disclosure. In the present example, electroplating method 10 includes a number of process steps identified as STEPS 12, 14, 16, 18, 20, 22. The initial three steps of method 10 (STEPS 12, 14, 16) are performed pursuant to a first overarching sub-process identified as "PROCESS BLOCK 24" in FIG. 1, while the latter three steps (STEPS 18, 20, 22) are carried-out pursuant to second overarching sub-process identified as "PROCESS BLOCK 26." Depending upon the particular manner in which electroplating method 10 is implemented, each illustrated step (STEPS 12, 14, 16, 18, 20, 22) may entail a single process or multiple sub-processes. Further, the steps shown in FIG. 1 and described below are offered purely by way of non-limiting example. In alternative embodiments of electroplating method 10, additional process steps may be performed, certain steps may be omitted, and/or the illustrated steps may be performed in alternative sequences.

Electroplating method 10 commences at PROCESS BLOCK 24 during which a NiW plating bath having a desired chemistry is prepared. The NiW plating bath is prepared to contain wear resistant particles, which are dispersed in the bath as a charge modified particle-surfactant suspension. The particle-surfactant suspension is referred to "charge modified," in the present context, to denote that the net charge of the complex is modified relative to the native or initial charge of the wear resistant particles, as considered prior to binding to the selected surfactant type(s). Depending upon plating path chemistry and other factors, the modified charge of the particle-surfactant complex may favorably decrease the tendency of the hard wear particles to leave suspension, settle, and agglomerate within the plating bath. In so doing, the charge modified particle-surfactant suspension promotes more uniform particle distributions through the plating bath volume and prolongs the time period over which the wear resistant particles remain in suspension, as compared to similar plating bath chemistries containing hard wear particles not combined into such particle-surfactant complexes. As indicated in FIG. 1 by graphic 28, the charge modified particle-surfactant suspension is created by forming and dispersing a charged particle-surfactant complex in the plating bath at some juncture prior to the electroplating process, which is conducted during PROCESS BLOCK 26 of method 10.

Any number and type of surfactants may be utilized to create a charge modified particle-surfactant suspension having the desired properties; e.g., improvements in particle suspension stability and dispersal uniformity within the NiW plating bath. Generally, the selected surfactant or surfactants will vary between implementations of method 10 based upon plating bath chemistry, the selected wear resistant particle type or types, and other such factors. In embodiments, only a single surfactant type may be added to the NiW plating bath and utilized to create the charge modified particle-surfactant suspension. In other embodiments, two or more surfactant types may be combined with the wear resistant particles to yield a particle-surfactant complex having a desired net charge. In this latter case, the selected surfactant or surfactants can be anionic (negatively charged) or cationic (positively charged). For example, in certain implementations, at least one anionic surfactant and at least one cationic surfactant are added to plating bath chemistry when preparing the NiW plating bath during PROCESS BLOCK 24, as described more fully below.

In addition to the selected surfactant or surfactants, the NiW plating bath chemistry may also be prepared to contain the selected wear resistant particle type or types, at least one Ni ion source, at least one W ion source, and a liquid carrier, such as an aqueous or alcohol-based solvent. Generally, the Ni ion source may be provided in the form of a chemical additive (e.g., a nickel sulfate compound) introduced into the plating bath, in which case inert (e.g., titanium-plated platinum) anodes may be inserted into the NiW plating bath and energized to carry-out the electroplating process. In further implementations, the Ni ion source may be provided utilizing consumable or soluble nickel anodes, which are replenished as needed during the electroplating process. Comparatively, the W ion source may be provided as sodium tungstate dihydrate ($Na_2WO_4.2H_2O$) or another water-soluble additive. The plating bath chemistry may also be formulated to include other ingredients or constituents including chelating agents and pH balancing agents; e.g., in one embodiment, a complex of citric acid ($C_6H_8O_7$) and ammonia ($NH_3$) may be provided within the bath to serve as a chelating or structuring agent. Various other bath formulations are also possible.

In implementations in which multiple surfactant types are utilized to form the charge modified particle-surfactant complex, the different surfactant types may be contacted with the wear resistant particles in a predetermined sequence or order. For example, in embodiments in which an anionic (negatively charged) surfactant and a cationic (positively charged) surfactant are combined with the wear resistant particles to yield the charge modified particle-surfactant complex, the anionic surfactant may be initially contacted with the wear resistant particles. When so contacted, the anionic surfactant binds with the wear resistant particles to form inner surfactant layers enveloping the particles and imparting the resultant intermediary particle-surfactant complex with a net negative charge. This intermediary particle-surfactant complex is then contacted with the cationic surfactant. The second, cationic surfactant further binds to the inner surfactant layers to form outer surfactant layers enveloping the inner surfactant layers. A double layer particle-surfactant complex is thereby formed, which possess a net positive charge exceeding the native charge of the wear resistant particles considered in isolation. In effect, then, the anionic surfactant is utilized to tether the cationic surfactant to the wear resistant particles and form the final double layer particle-surfactant complex. The resulting net positive charge of the complex may promote substantially uniform particle distribution through the bath and prolong particle suspension longevity. Such effects may be further bolstered by the natural tendency of the surfactant to decrease tension between the wear resistant particles and the liquid content of the plating bath. Moreover, as an additional benefit, the net positive charge of the particle-surfactant complex may aid in deposition of the particles via attraction to metallic component when serving as a cathode during electroplating.

With continued reference to PROCESS BLOCK 24 and referring specifically to STEP 12 of electroplating method 10, the wear resistant particles and the selected surfactant types are purchased from a third party supplier, independently fabricated, or otherwise obtained. The particular type or types of wear resistant particles obtained during STEP 12 of method 10 will vary depending upon plating bath chemistry, the desired plating system properties, and other such factors. Generally, the wear resistant particles may be composed of any material or combination of materials appreciably enhancing the resistance of the desired NiW plating system to surface damage, particularly when subject to high contact forces under elevated temperature conditions. The wear resistant particle type or types may be selected to enhance other desired properties to the NiW plating system, as well, such as microhardness and lubricity. To this end, in embodiments, the wear resistant particles may be selected to have a hardness greater than the NiW matrix itself. In this case, the wear resistant particles may be more specifically referred to herein as "hardness enhancing particles." In other instances, the wear resistant particles may be selected to improve the lubricity of the NiW matrix, particularly when some fraction of the wear resistance particles is exposed along an outer principal surface of the NiW plating composite or system. In this latter case, the hard wear particles may be more specifically referred to as "solid film lubricant particles."

A non-exhaustive list of solid film lubricant particles suitable for usage in electroplating method 10 includes h-BN particles and molybdenum disulfide ($MoS_2$) particles, as well as particles composed of carbon allotropes including graphite and graphene. A non-exhaustive list of suitable hardness enhancing particles includes alumina ($Al_2O_3$), beryllium carbide ($Be_2C$), beryllium oxide (BeO), carbon black, chromium carbide ($Cr_3C_2$), aluminum boride ($AlB_2$), boron carbide ($B_4C$), silica ($SiO_2$), silicon carbide (SiC), tantalum carbide (TAC), titanium carbide (TiC), titanium nitride (TiN), tungsten carbide (WC), aluminum nitride (AlN), zirconium carbide (ZrC), zirconium diboride ($ZrB_2$), zirconium dioxide ($ZrO_2$), and zirconium silicate ($ZrSiO_4$) particles. The wear resistant particles selected for incorporation into a given plating system or composite will vary amongst embodiments and may include one or more types of solid film lubricant particles, one or more types of hardness enhancing particles, or a combination of solid film lubricant particles and hardness enhancing particles. In one embodiment, method 10 is carried-out utilizing h-BN nanoparticles, alumina ($Al_2O_3$) nanoparticles, or a combination thereof.

As will the selected type or composition of wear resistant particles, the shape and size of the wear resistant particles will vary between implementations of electroplating method 10. In many instances, the wear resistant particles will posses generically spherical form factors; however, other particle form factors are also possible including oblong, rod, whisker, and platelet or laminae particle shapes. In certain embodiments, the average maximum dimension of the selected wear resistant particles (e.g., the average diameter, length, or analogous dimensions depending upon particle shape) may range from about 10 nanometers (nm) to about 10 microns (μm). In other embodiments, the average maximum dimensions of the wear resistant particles may be greater than or less than the aforementioned range. The selected wear resistant particles are conveniently, although non-essentially added to the plating bath in a dry powder form. In this case, the dried wear resistant particles can be combined with the selected (e.g., anionic and cationic) surfactants within the plating bath; or, instead, the wear resistant particles can be pre-coated with the selected surfactants prior to introduction into the plating bath.

The quantity of wear resistant particles added to the plating bath is selected in view of bath volume to provide a desired particle concentration within the NiW plating bath. The particle concentration in the NiW plating bath may, in turn, be determined as a function of the desired final particle content or "fill rate" of the NiW plating system to be deposited. In implementations in which hardness enhancing particles are utilized, the final NiW plating system may contain about 0.1 to about 30 wt % wear resistant particles; e.g., in one embodiment, the NiW plating system may be deposited to contain between 1 to 10 wt % and, more preferably, about 1 to 3 wt % alumina ($Al_2O_3$) particles. Comparatively, in embodiments in which solid film lubricant particles are utilized as the hard wear particles, the completed NiW plating system may desirably contain about 0.01 to about 20 wt % hard wear particles; e.g., as a specific example, the NiW plating system may be deposited to contain between 0.1 to 10 wt % and, more preferably, about 1 to 3 wt % h-BN particles. Similarly, in other embodiments, the NiW plating system may be deposited to contain or have a fill rate of 0.1 to wt % of the wear resistant particles, which may be present in the form of hardness enhancing (e.g., alumina) particles and/or solid film lubricant (e.g., h-BN) particles. It has been determined that, even when present in relatively low concentrations (e.g., less than 1% by volume) in the deposited NiW plating system, the inclusion of wear resistant particles can favorably enhance wear resistance, microhardness, lubricity, and other characteristics of the plating system.

Generally, any surfactant type or types can be selected for usage in method 10, which are capable of binding to the chosen wear resistant particles to form charged particle-surfactant complexes as described herein. Continuing the example introduced above in which at least two surfactant types (anionic and cationic surfactants) are bound to the wear resistant particles, suitable candidates for usage as the anionic and cationic surfactant types are as follows. In one implementation, the anionic surfactant assumes the form of an organosulfate compound, such as SDS, which is initially contacted with the selected wear resistant particles. The SDS binds with the wear resistant particles to form inner surfactant layers enveloping the particles. This yields an intermediary or transitory single layer charged particle-surfactant complex having a net negative charge. Afterwards, a second, cationic surfactant is then contacted with the intermediary particle-surfactant complex. The second, cationic surfactant surrounds and binds to the inner surfactant layers to form outer surfactant layers. This yields a final, double layer charged particle-surfactant complex having an enhanced or boosted net positive charge. In such embodiments, the cationic surfactant can be, for example, PEG-8 or a quaternary ammonium surfactant, such as CTAB. It has been found that CTAB-based surfactants are beneficially utilized in combination with SDS surfactants and hardness enhancing particles, such as alumina ($Al_2O_3$) particles. Comparatively, PEG-8-based surfactants are well-suited for usage in combination with SDS surfactants and certain solid film lubricant particles, such as h-BN particles. As appearing here and elsewhere in this document, the term "PEG-8" or, more fully, "PEG-8 methyl ether dimethicone" refers to a chemical composition composed of silicones and siloxanes, dimethyl, 3-(methylpoly(oxy-1,2-ethanediyl))propyl methyl, and trimethylsilyl terminated. Care should be taken to distinguish this chemical compound from the similarly-named "PEG" compound.

Figure 2:
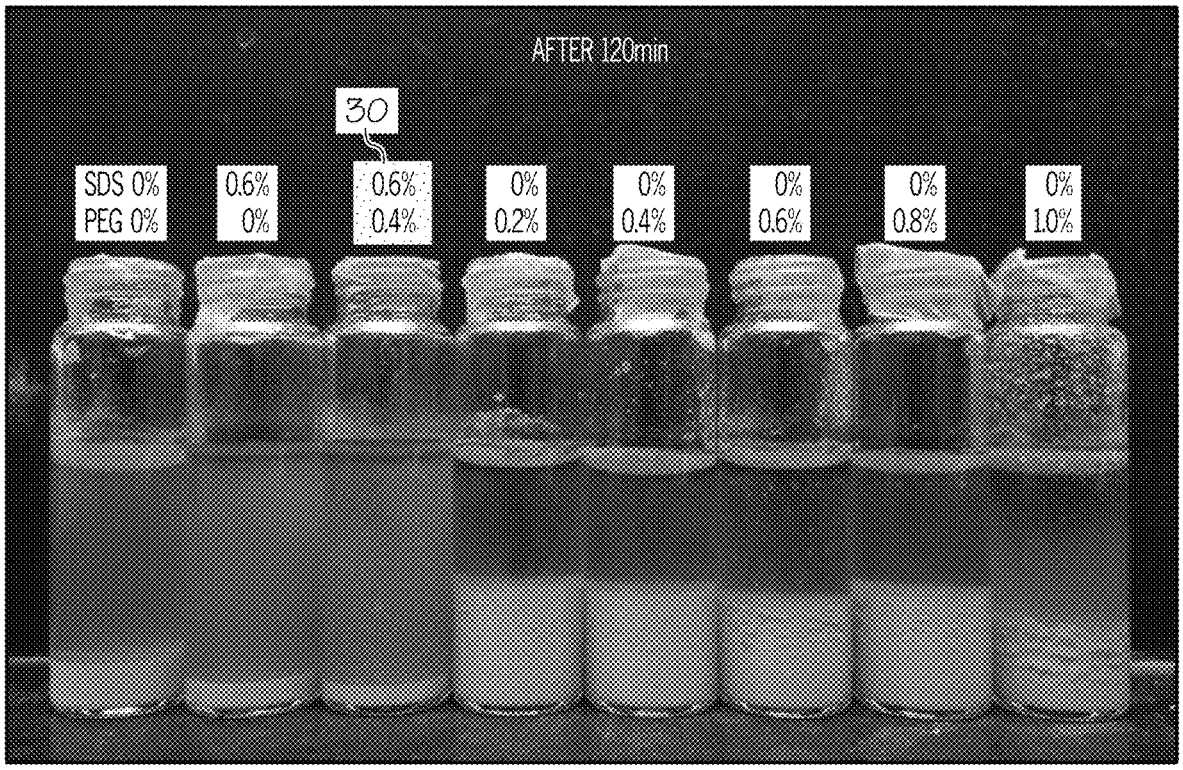
FIG. 2 is a picture of vials holding sample plating bath formulations containing charged particle-surfactant complexes suitable for usage on a larger scale when implementing the method of FIG. 1, as prepared to measure the settling rates of the sample formulations.

The amount of the surfactant type or types contained within the plating bath may be optimized based upon the cumulative surface area of the wear resistant particles and is thus usefully selected based upon particle size and quantity in the plating bath solution. Testing has been conducted to identify certain optimized surfactant concentrations for usage in implementations of electroplating method 10. Consider, for example, FIG. 2 presenting a picture of several vials of sample plating bath mixtures containing wear resistant particle suspensions and varying concentrations of two surfactant types; in this example, SDS and PEG-8 surfactants. The pictured samples were initially prepared as above and then allowed to remain undisturbed for a time period of approximately 120 minutes. Afterwards, cake thicknesses and the opacity or suspension cloudiness were compared. As visually denoted by graphic 30 in FIG. 2, the combination of 0.6 wt % and 0.4 wt % SDS and PEG-8, respectively, was found to yield the charge modified particle-surfactant suspension most resistant to the emergence of particles from suspension, agglomeration, and settling. Further, most, not all of the tested plating bath formulations were found to improve particle suspension stability as compared to plating bath formulations lacking charged surfactants. It was also noted that the cake could easily be returned to suspension through agitation of the plating bath mixtures.

Returning once again to FIG. 1, the wear resistant particles and the selected surfactant or surfactants are introduced into the plating bath at STEP 14 of electroplating method 10. As indicated above, the wear resistant particles and the selected surfactant type(s) may be initially combined within the plating bath itself or, perhaps, prior to plating bath introduction. For example, in certain implementations, the wear resistant particles and the surfactant(s) may be initially combined into the particle-surfactant complex (or a precursor of the particle-surfactant complex) prior to plating bath introduction. In this case, a suspension may be created containing wear resistant particles and the selected surfactant(s), filtered, and desiccated to yield dried, surfactant-coated particles, which can be introduced into the plating bath at a later juncture when needed. Comparatively, in other embodiments, the wear resistant particles and surfactant type(s) may first contact when added to the plating bath. In this case, the wear resistant particles and surfactant(s) may be added to the plating bath as separate additives, and perhaps in a particular sequence, to allow the desired particle-surfactant complex to form within the bath. In either case, thorough dispersal of the wear resistant particles and the surfactant type(s) in the plating bath is usefully performed in conjunction with or following plating bath introduction.

During or immediately prior to the electroplating process, various other tunable plating bath parameters may be set and possibly adjusted in situ to further prolong the longevity and distribution uniformity of the charge modified particle-surface complex. Selection of appropriate bath agitation levels may be impactful in this regard; and, as certain instances, may range from 100-1000 revolutions per minute (RPM). Control of the pH level of the plating bath may also impact the manner in which plating bath chemistry influences the net charge carried by the particle-surfactant complex; e.g., in at least some embodiments, a lower bath pH may reduce particle settling and agglomeration by permitting a stronger surface charge on the particle-surfactant complex. Accordingly, in one implementation, bath chemistry is formulated to maintain the pH of the plating bath between about 5 and about 9 and, more preferably, a pH of about 7±1 through the electroplating process. In other instances, the pH level of the plating bath may be greater or less than the aforementioned range. As indicated in FIG. 1, such additional preparation processes may be performed at STEP 16 of method 10.

Advancing to PROCESS BLOCK 26 of electroplating method 10, the NiW plating system or composite is next formed over targeted surfaces of the metallic components. During STEP 18, one or more metallic components may be at least partially submerged in the plating bath utilizing, for example, a rack or other fixture permitting the application of a controllable electrical potential to the components. In other embodiments, a continual reel approach may be employed to move the metallic components through the plating bath. One or more electrodes, such as soluble or non-soluble anodes, are further inserted into the plating bath. The electroplating process is then carried-out at STEP 20 of method 10. Electroplating is conducted via the energization of the anode or anodes submerged in the plating bath, as well as the metallic components to be plated (again, serving as cathodes). As indicated above, the selected anodes may be consumable and serve as a metal ion source; or, instead, the anodes may be non-consumable and liquid chemicals within the plating bath may serve as the metal ion donors. Either direct or alternating (pulsed) current may be delivered through the electrodes, with current densities and other such factors tailored to achieve desired deposition rates. As previously stated, agitation levels, temperature, and other such factors may also be controlled, as appropriate, to support a desired plating rate and to ensure adequate availability of fresh metal ions within the deposition or "diffusion" zone. In at least some instances, the surfactants may dissociate from the wear resistant particles within the diffusion zone such that little surfactant content is present in the completed NiW plating system.

Figure 3:
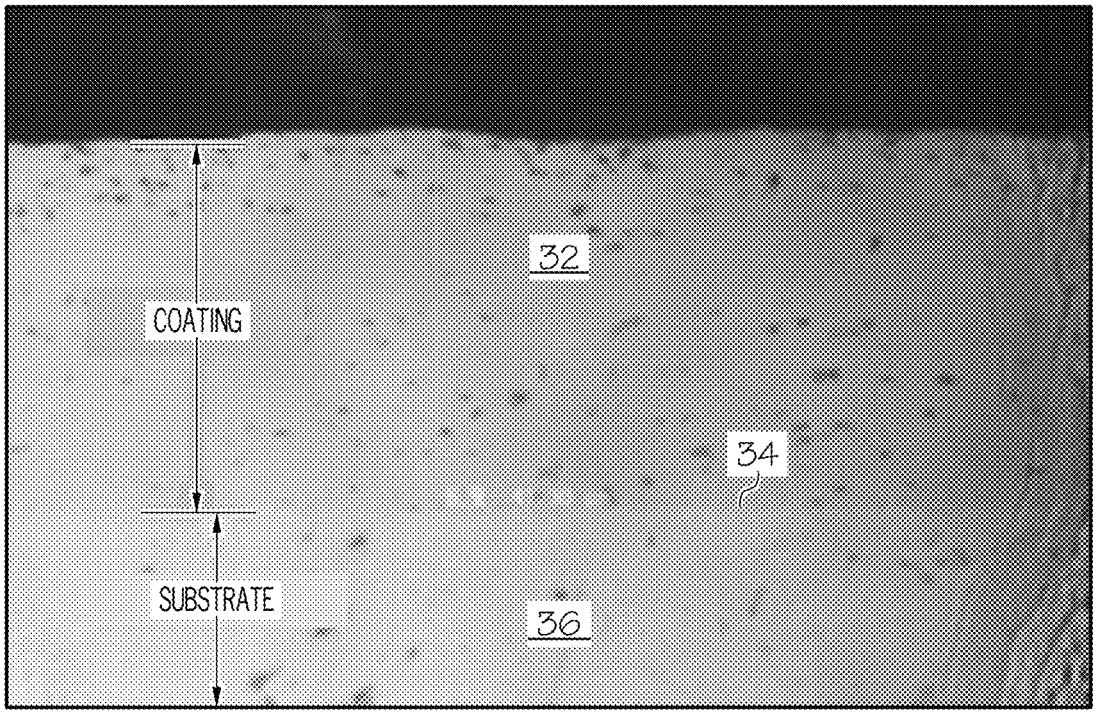
FIG. 3 is an SEM image of an exemplary NiW plating system deposited over a metallic component and containing embedded wear resistant particles, as produced in an exemplary implementation of the method set-forth in FIG. 1 reduced to practice.

Upon completion of the electroplating, a NiW plating system or composite is produced in which the wear resistant particles are embedded. In embodiments, and as noted above, the resulting NiW plating system may be produced to have a wear resistant particle content or fill percentage between about 0.1 and about 30 wt %, with the remainder of the NiW plating system containing or consisting essentially of Ni and W. In many implementations, the wear enhancing particles and the resulting plating system will be substantially free of organic materials; that is, contain less than 1 wt % organic materials. In one specific embodiment, the resulting NiW plating system contains between about 0.1 and 5 wt % wear resistant particles, with the wear resistant particles assuming the form of h-BN particles, alumina ($Al_2O_3$) particles, or a combination thereof. In other implementations, the NiW plating system may further contain a majority of Ni and W, by wt %; and, perhaps, may consist essentially of Ni, W, and the wear resistant particles. FIG. 3 is an SEM of an exemplary NiW plating system 32, as produced pursuant to an implementation of electroplating method 10 reduced to practice. As can be seen, NiW plating system 32 is formed over a targeted surface 34 of a metallic component 36 (only a limited portion of which is shown). The wear resistant particles appear as localized, darker regions of NiW plating system 32 and are embedded in the surrounding NiW matrix (the lighter colored body of composite or system 32).

Following completion of the electroplating process, and as indicated at STEP 22 of method 10, any number and type of post-plating processing steps may be performed to complete fabrication of the NiW plating system. Such post-electroplating processing steps can include the formation of additional coating layers, heat treatment, and/or machining. For example, polishing, grinding, lapping, and machining process may be carried-out to impart the final NiW plating system with a desired final thickness and/or a surface finish. Heat treatment may be performed to partially or fully decompose any organic materials remaining with the plating system, to relieve material stresses, to densify the plating system, and/or to otherwise modify the properties of the plating system. Additional layers or topcoats can also be formed over the NiW plating system, if so desired. Alternatively, the NiW plating system may be left as the outermost coating or top layer of the completed component.

Testing Examples

The first table below (TABLE 1) sets-forth relevant parameters for multiple testing trials conducted on NiW plating systems containing embedded alumina particles. To produce the plating systems, alumina powder was dispersed in a water containing SDS and a CTAB surfactant. Specifically, a charge modified particle-surfactant suspension was created by initially adding a SDS (an anionic surfactant) to the plating bath concurrently with or after introduction of the alumina particles. CTAB (a cationic surfactant) was then added, and the electroplating process was carried-out in accordance with the parameters below. In obtaining the following testing results, the amount of SDS added was approximately 0.1 grams per liter, while the amount of CTAB added was approximately 0.2 grams per liter. Alumina nanoparticles were utilized having maximum average cross-sectional dimensions between approximately 40 nm and 50 nm. Testing results indicate favorable improvements in suspension stability at pH values equal to or less than approximately 6.9, while flocculation was observed at pH values equal to or greater than approximately 7. Without being bound by theory, it is believed that pH values slightly to moderately less than 7, without being overly acidic, reduce the settling rate by providing a greater charge on the particle-complex surface. An optimal SDS to wear resistant particle (powder) ratio was further tested and determined to be approximately 0.08 by dry wt %. Finally, the alumina solid loading of the NiW plating system in the following examples is approximately 5 wt %.

TABLE 1

| Alumina Content (g/l) | Agitation (RPM) | Current Density (ASD) | W (wt %) | Current Efficiency (μ/%) | Microhardness after plating (HV) | Microhardness after heating (HV) |
|---|---|---|---|---|---|---|
| 30 | 400 | 2.0 | 27 | 37 | 637 | 709 |
| 20 | 500 | 3.5 | 29 | 43 | 690 | 741 |
| 30 | 600 | 5.0 | 30 | 42 | 581 | 725 |
| 10 | 400 | 5.0 | 31 | 39 | 554 | 756 |
| 10 | 600 | 2.0 | 27 | 41 | 681 | 764 |

In TABLE 1, alumina content is expressed in grams per liter, agitation is expressed in revolutions per minute, and current density is expressed in amps per decimeter squared. As further labeled above, W content of the NiW plating deposit is expressed in weight percentage, and the microhardness values are expressed in Vickers Pyramid Number (HV) values. In other testing, microhardness values exceeding 600 HV and, in certain cases, approaching or exceeding 1200 HV were observed. Comparatively, conventional hex chromate platings are typically characterized by microhardness values between about 900 and about 950 HV.

The second table below (TABLE 2) similarly presents relevant parameters for several trials conducted for the preparation NiW plating systems containing wear resistant particles. In contrast to the examples set-forth in TABLE 1 above, the hard wear particles assumed the form of h-BN particles embedded in the NiW plating system. In the following examples set-forth in TABLE 2, a plating bath was initially prepared containing a charge modified particle-surfactant suspension. The charge modified particle surfactant suspension was produced by initially adding a SDS surfactant to the plating bath concurrently with or after introduction of the h-BN particles. A PEG-8 surfactant was then introduced into the plating bath, allowed to form a double layer charged modified particle-surfactant complex, and electroplating was carried-out in accordance with the parameters below.

TABLE 2

| h-BN Content (g/l) | Agitation (RPM) | Current Density (ASD) | W (wt %) | Current Efficiency (μ/%) | Microhardness after plating (HV) | Microhardness after heating (HV) |
|---|---|---|---|---|---|---|
| 10 | 500 | 2.0 | 28 | 47 | 602 | 771 |
| 5 | 600 | 3.5 | 24 | 54 | 554 | 636 |
| 15 | 600 | 5.0 | 28 | 52 | 575 | 726 |
| 5 | 400 | 5.0 | 31 | 41 | 580 | 721 |
| 15 | 400 | 2.0 | 23 | 54 | 518 | 623 |

CONCLUSION

Methods for electrodepositing NiW plating systems containing wear resistant particles have been provided. As described above, the wear resistant particles can include solid film lubricant particles, hardness enhancing particles, and combinations thereof. In certain embodiments of the above-described method, charged surfactants are introduced into the NiW plating baths for enhancing particle suspension stability. Such charged surfactants bind with the wear resistant particles to impart a desired cumulative electrical charge to the resulting particle-surfactant complex. This cumulative electrical charge prolongs particle suspension longevity and uniformity and, when positive, may also aid in deposition of the particles via attraction to the cathode. Through the introduction of such charged surface-particle suspensions along with tailoring other bath chemistry properties, wear resistant particles can be maintained in relatively uniform suspensions within the NiW plating bath for prolonged periods of time. This promotes substantially homogenous distributions of the hardness enhancing particles in the plating bath and, in at least some cases, the formation of NiW deposits having substantially uniform particle concentrations through the coating thickness. The particle-containing NiW composite may thus be relatively resistant to surface damage, such as galling, when subject to severe contact forces under high temperature operating conditions. Additionally, the particle-containing NiW composite may possess relatively high microhardness levels and lubricities. Embodiments of the NiW plating are consequently well-suited for utilization in place of conventional electroplated coatings, such as hex chrome, in high temperature wear applications to protect component surfaces in the presence of higher contact forces.

In various embodiments, the above-described method includes preparing a NiW plating bath containing a particle suspension. The NiW plating bath may be prepared by, for example, introducing wear resistant particles into the NiW plating path and adding at least one charged surfactant. The first type of wear resistant particles and the first charged surfactant may be contacted when introduced into the NiW plating bath or prior to introduction into the NiW plating bath. The at least one charged surfactant binds with the wear resistant particles to form a particle-surfactant complex. The wear resistant NiW plating system is then electrodeposited onto a surface of a component at least partially submerged in the NiW plating bath. The resulting wear resistant NiW plating system comprised of a NiW matrix in which the wear resistant particles are embedded.

The following enumerated statements may further describe the general embodiment of the method set-forth in the preceding paragraph (as considered in the alternative unless otherwise stated):

(i) the method may further include further comprising formulating the at least one charged surfactant to impart the particle-surfactant complex with a net positive charge exceeding a native positive charge of the wear resistant particles;

(ii) the method may further include selecting the at least one charged surfactant to comprise an anionic surfactant and a cationic surfactant;

(iii) when including the features or steps set-forth in romanette (ii), the method may further include: initially contacting the wear resistant particles with the anionic surfactant to produce an intermediary particle-surfactant complex with a net negative charge; and after initially contacting the wear resistant particles with the anionic surfactant, subsequently contacting the intermediary particle-surfactant complex with the cationic surfactant to yield the particle-surfactant complex;

(iv) when including the features or steps set-forth in romanette (iii), the method may further include pre-coating the wear resistant particles with the anionic surfactant and the cationic surfactant prior to introduction into the NiW plating bath;

(v) when including the features or steps set-forth in romanette (iii), the method may further include initially contacting the wear resistant particles, the anionic surfactant, and the cationic surfactant within the NiW plating bath;

(vi) when including the features or steps set-forth in romanette (ii), the method may further include: selecting the anionic surfactant to comprise an organosulfate compound; and selecting the cationic surfactant to comprise cetyltrimethylammonium bromide, methyl ether dimethicone, or a combination thereof;

(vii) when including the features or steps set-forth in romanette (vi), the method may further include selecting the anionic surfactant to comprise sodium dodecyl sulfate;

(viii) the method may further include: selecting the wear resistant particles to have a hardness greater than that of the NiW matrix; and selecting the at least one charged surfactant to comprise cetyltrimethylammonium bromide;

(ix) the method may further include: selecting the wear resistant particles to comprise solid film lubricant particles; and selecting the at least one charged surfactant to comprise methyl ether dimethicone;

(x) the method may further include selecting the wear resistant particles to comprise alumina nanoparticles, hexagonal boron nitride nanoparticles, or a combination thereof;

(xi) the method may further include selecting the wear resistant particles to comprise alumina particles; and selecting the at least one charged surfactant to comprise sodium dodecyl sulfate and cetyltrimethylammonium bromide;

(xii) the method may further include: selecting the wear resistant particles to comprise hexagonal boron nitride particles; and selecting the at least one charged surfactant to comprise sodium dodecyl sulfate and methyl ether dimethicone;

(xiii) the method may further include selecting a concentration of the wear resistant particles in the NiW plating bath and electrodepositing the wear resistant NiW plating system such that the NiW plating system has a fill rate between 0.1 and 10% wear resistant particles, by weight; or (xiv) the method may further include: selecting the at least one charged surfactant to comprise cetyltrimethylammonium bromide; and introducing between about 2.5 and about 10% cetyltrimethylammonium bromide to the NiW plating bath, by weight.

Terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements. While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. Various changes may be made in the function and arrangement of elements described in an exemplary embodiment without departing from the scope of the invention as set-forth in the appended Claims.

What is claimed is:

1. A method for forming a wear resistant nickel tungsten (NiW) plating system, the method comprising:

preparing a NiW plating bath containing a particle suspension, preparing comprising:

introducing wear resistant particles into the NiW plating bath, the wear resistant particles comprising alumina particles;

selecting an amount of at least one charged surfactant based on a particle size of the alumina particles, a cumulative surface area of the alumina particles and the quantity of the alumina particles in the NiW plating bath, the at least one charged surfactant comprising sodium dodecyl sulfate and cetyltrimethylammonium bromide;

adding to the NiW plating bath the at least one charged surfactant, the at least one charged surfactant binding with the wear resistant particles to form a particle-surfactant complex; and electrodepositing the wear resistant NiW plating system onto a surface of a component at least partially submerged in the NiW plating bath, the wear resistant NiW plating system comprised of a NiW matrix in which the wear resistant particles are embedded.

2. The method of claim 1 further comprising formulating the at least one charged surfactant to impart the particle-surfactant complex with a net positive charge exceeding a native positive charge of the wear resistant particles.

3. The method of claim 1 further comprising:

initially contacting the wear resistant particles with the sodium dodecyl sulfate to produce an intermediary particle-surfactant complex with a net negative charge; and after initially contacting the wear resistant particles with the sodium dodecyl sulfate, subsequently contacting the intermediary particle-surfactant complex with the cetyltrimethylammonium bromide to yield the particle-surfactant complex.

4. The method of claim 3 further comprising pre-coating the wear resistant particles with the sodium dodecyl sulfate and the cetyltrimethylammonium bromide prior to introduction into the NiW plating bath.

5. The method of claim 3 wherein the wear resistant particles, the sodium dodecyl sulfate, and the cetyltrimethylammonium bromide are initially contacted within the NiW plating bath.

6. The method of claim 1 further comprising:

selecting the wear resistant particles to have a hardness greater than that of the NiW matrix.

7. A method for forming a wear resistant nickel tungsten (NiW) plating system, the method comprising:

preparing a NiW plating bath containing a particle suspension, preparing comprising:

introducing wear resistant particles into the NiW plating bath, the wear resistant particles comprising hexagonal boron nitride particles;

selecting an amount of at least one charged surfactant based on a particle size of the wear resistant particles and a quantity of the wear resistant particles in the NiW plating bath, the at least one charged surfactant comprising sodium dodecyl sulfate and PEG-8 methyl ether dimethicone;

adding to the NiW plating bath the at least one charged surfactant, the at least one charged surfactant binding with the wear resistant particles to form a particle-surfactant complex; and electrodepositing the wear resistant NiW plating system onto a surface of a component at least partially submerged in the NiW plating bath, the wear resistant NiW plating system comprised of a NiW matrix in which the wear resistant particles are embedded.

8. The method of claim 1 wherein further comprising selecting a concentration of the wear resistant particles in the NiW plating bath and electrodepositing the wear resistant NiW plating system such that the NiW plating system has a fill rate between 0.1 and 10% wear resistant particles, by weight.

9. The method of claim 1 further comprising:

introducing about 0.2 grams per liter cetyltrimethylammonium bromide to the NiW plating bath.

* * * * *